US012618624B2

(12) United States Patent
Patel

(10) Patent No.: US 12,618,624 B2
(45) Date of Patent: May 5, 2026

(54) MODULAR BOLT ACTION RIFLE

(71) Applicant: DEFENSE RESEARCH AND DEVELOPMENT, LLC, Dallas, GA (US)

(72) Inventor: Swetal K. Patel, Dallas, GA (US)

(73) Assignee: Defense Research and Development, LLC, Dallas, GA (US)

( * ) Notice: Subject to any disclaimer, the term of this patent is extended or adjusted under 35 U.S.C. 154(b) by 71 days.

(21) Appl. No.: 18/464,895

(22) Filed: Sep. 11, 2023

(65) Prior Publication Data

US 2024/0085127 A1 Mar. 14, 2024

Related U.S. Application Data

(60) Provisional application No. 63/405,272, filed on Sep. 9, 2022.

(51) Int. Cl.

| | |
|---|---|
| ***F41A 3/66*** | (2006.01) |
| ***F41A 21/48*** | (2006.01) |
| ***F41C 23/16*** | (2006.01) |
| *F41A 3/72* | (2006.01) |

(52) U.S. Cl.
CPC ..... *F41A 3/66* (2013.01); *F41A 21/48* (2013.01); *F41C 23/16* (2013.01); *F41A 3/72* (2013.01)

(58) Field of Classification Search
CPC ..... F41A 3/66; F41A 21/48; F41A 21/484; F41A 21/485; F41A 21/487; F41A 3/72; F41A 11/09; F41A 11/02; F41A 319/13; F41A 19/25; F41A 19/26; F41A 19/27; F41C 23/16
See application file for complete search history.

(56) References Cited

U.S. PATENT DOCUMENTS

| | | | | |
|---|---|---|---|---|
| 534,691 | A * | 2/1895 | Hepburn | F41A 21/482 42/75.02 |
| 3,731,418 | A * | 5/1973 | Birkenhagen | F41A 21/487 42/75.02 |
| 8,276,304 | B2 * | 10/2012 | Samson | F41C 23/16 42/72 |
| 10,921,081 | B2 * | 2/2021 | Pichler | F41A 21/487 |
| 11,953,281 | B2 * | 4/2024 | Chiera | F41A 21/482 |

(Continued)

*Primary Examiner* — Joshua E Freeman
(74) *Attorney, Agent, or Firm* — Perilla Knox & Hildebrandt LLP; Kenneth A. Knox

(57) ABSTRACT

The present disclosure presents a modular bolt action rifle system with roller bearings having an upper receiver assembly housing a barrel, a lower receiver assembly comprising an AR-style fire control system and a magazine well, a bolt carrier group assembly including a bolt carrier, top roller bearings and side roller bearings, and a handguard assembly, wherein the lower receiver assembly and its AR-style fire control and magazine well are releasably attached to the upper receiver, and prior to attachment of the barrel assembly the bolt carrier group assembly, consisting of the bolt carrier, bolt head, bolt charging handle, top roller bearings, and side roller bearings is inserted unto the upper receiver. An extension of the barrel assembly is releasably attached to the upper receiver. The barrel assembly is releasably secured by releasable attachment of the handguard assembly to a barrel extension receiver of the upper receiver assembly.

12 Claims, 16 Drawing Sheets

(56) References Cited

U.S. PATENT DOCUMENTS

| | | | | |
|---|---|---|---|---|
| 2006/0026883 | A1* | 2/2006 | Hochstrate | F41C 23/16 42/75.01 |
| 2014/0150318 | A1* | 6/2014 | Engesser | F41A 35/00 42/75.02 |
| 2015/0369555 | A1* | 12/2015 | Daniel | F41A 21/487 42/75.02 |
| 2019/0170476 | A1* | 6/2019 | Hiler, Jr. | F41A 21/482 |
| 2019/0301827 | A1* | 10/2019 | Chebanova | F41G 11/004 |
| 2020/0263942 | A1* | 8/2020 | Karagias | F41A 15/14 |
| 2020/0271403 | A1* | 8/2020 | Ives | F41A 3/66 |
| 2020/0378702 | A1* | 12/2020 | DiChario | F41A 5/20 |
| 2020/0386495 | A1* | 12/2020 | Hamilton | F41A 3/18 |
| 2021/0381784 | A1* | 12/2021 | Alomaira | F41A 3/72 |

* cited by examiner

MODULAR BOLT ACTION RIFLE

CROSS-REFERENCE TO RELATED APPLICATION

This application claims priority to U.S. provisional application entitled, "Modular Bolt Action Rifle," having application No. 63/405,272, filed Sep. 9, 2022, which is entirely incorporated herein by reference.

TECHNICAL FIELD

The present disclosure is generally related to modular bolt-action rifles.

BACKGROUND

A rifle is a type of weapon that fires rounds. Typically, the rifle includes a trigger, a hammer, and a barrel. The round is positioned in the barrel, and, when the trigger is pulled, the hammer fires the round through the barrel.

A bolt action rifle is loaded by a manually operated bolt. The rifle bolt is operated manually by using a bolt handle to open and close the breech. The breech is opened by rotating the bolt handle to unlock the bolt from the receiver and pulling it rearward to open the breech. Opening the breech provides for the extraction and ejection of a spent cartridge case, cocks the firing pin, and draws a new cartridge round from the magazine and into the breech. The bolt is closed by rotating the bolt handle to the original closed position to make the rifle ready to fire again.

The M1903 Springfield rifle is a type of conventional bolt-action rifle used primarily during the first half of the $20^{th}$ century. The Remington M-700 rifle is another type of conventional bolt-action rifle commonly used by civilians for hunting and by military and civilian law-enforcement agencies as sniper rifles.

A modular rifle typically includes a lower receiver assembly, an upper receiver assembly housing the barrel, and a coupling mechanism. The M-16 style rifle is a type of modular rifle system commonly used by military and police forces that features a gas-operated bolt and bolt carrier system, as disclosed, for example, in U.S. Pat. No. 2,951,424, issued to Eugene M. Stoner on Sep. 6, 1960 (incorporated herein by reference in its entirety). The AR-15 style rifle is a similarly designed modular rifle system commonly sold and used in civilian applications. An "AR-style" rifle is characterized by features derived from the ArmaLite Rifle ("AR") platform, particularly the AR-15, the hallmark of which is modularity allowing customization of components like barrels, stocks, handguards, and optics, as opposed to a rifle with a standardized receiver system. This modularity includes an upper receiver (housing the barrel, bolt, and gas system) attached to a lower receiver (containing the trigger group and magazine well), facilitating easy assembly and modification. The term "AR-style" applies to rifles known to comprise the AR-15's design, regardless of the manufacturer or specific model, and is often used to distinguish semi-automatic civilian versions from military counterparts like the aforementioned M-16.

Systems and methods for modular rifles and for quick take-down barrel systems and methods are disclosed in U.S. Pat. Nos. 7,810,271, 8,661,963, 8,689,478, and 8,739,449 issued to Swetal K. Patel.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
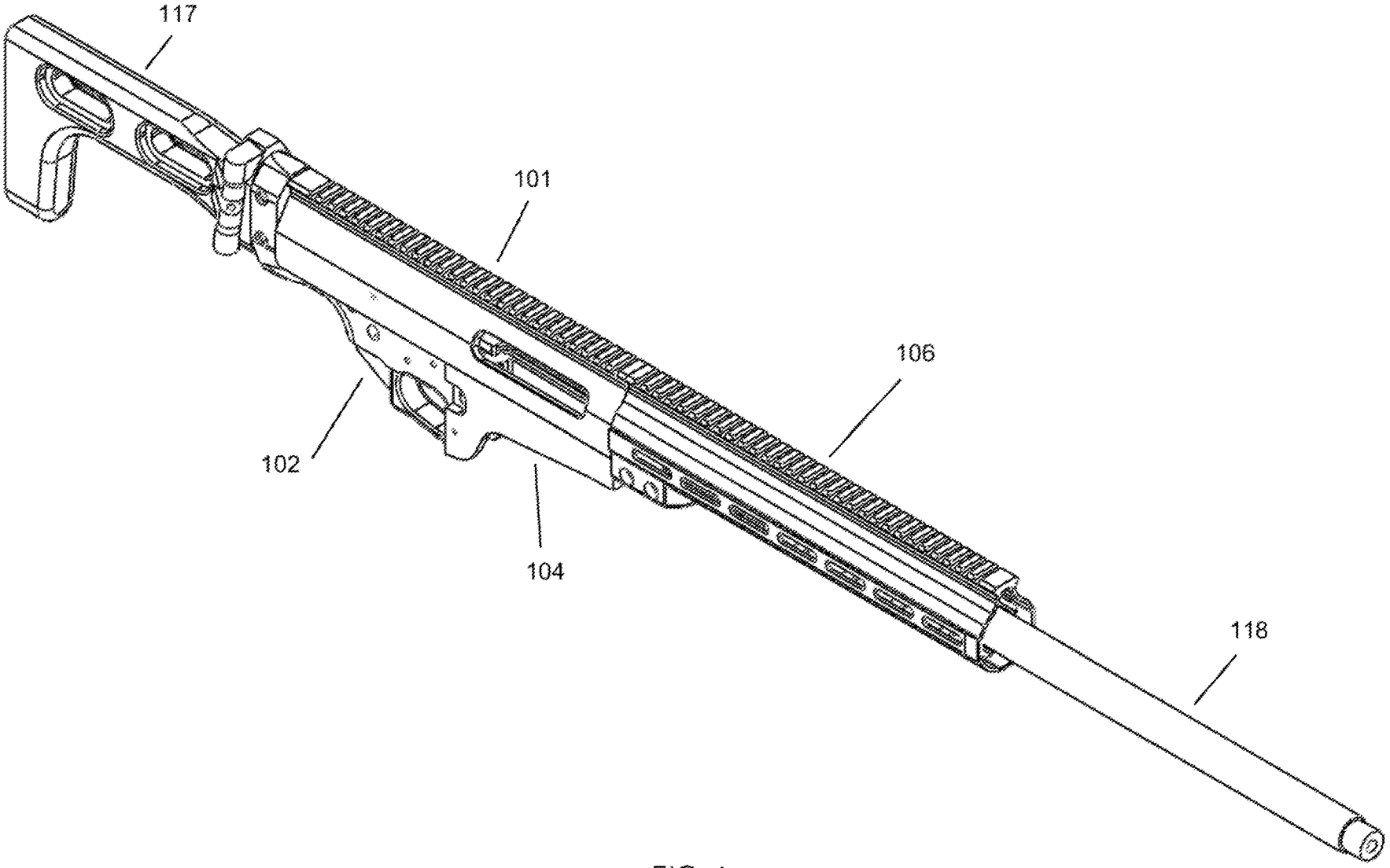
FIG. 1 is a perspective view of the assembled modular bolt action rifle system, showing the upper receiver, fire control, magazine well, stock, barrel, and handguard assembled in accordance with one exemplary embodiment of the present disclosure.

In embodiments of the present disclosure, a system and method is presented for quick changing of the rifle caliber and assembly and disassembly of bolt action modular-style rifle systems using an AR-style fire control. To change calibers, the system and method provides for an adjustable magazine well and interchangeable bolt, and barrel. For example, to change calibers from .338 Lapua caliber to .308 caliber, the bolt carrier guide pin is removed to allow for disassembly of the bolt carrier group, to include the .338 caliber bolt, firing pin, and bolt carrier. A .308 caliber bolt is placed in the rifle and the firing pin and bolt carrier guide pin are re-inserted. A .308 caliber magazine is placed in the machined channel of the magazine well where the rail maintains the magazine well between the rail and the lower receiver assembly. The .338 Lapua barrel with quick take-down assembly is removed, and a .308 caliber barrel is affixed to quick-take down assembly barrel extension with detents for shoulder screws. No other changes to the rifle are required in order to change from .338 Lapua caliber to .308 caliber.

In various embodiments, a bolt action rifle incorporates an AR-style fire control system. To assemble the rifle, the AR-style fire control is joined to an upper receiver assembly with a standard AR-style retaining pin.

In various embodiments, a modular bolt action rifle incorporates a floating magazine well, wherein the magazine well is inserted by aligning a channel on the top of the magazine well with channel tabs on the lower portion of the upper receiver and adjacent to the AR-style fire control.

In various embodiments, a modular bolt action rifle incorporates a floating bolt head assembly with a bolt, a bolt carrier, a firing pin with a machined slot to receive a bolt carrier guide pin, and the bolt carrier guide pin inserted into a slot in the carrier.

In various embodiments, a modular bolt action rifle provides for changing of rifle calibers among .338 Lapua, .338 Norma, .300 Norma, .416 Rigby, and .308 calibers. When calibers are changed, standard magazines for the desired caliber can be used without the requirement for custom magazines for the rifle, as, for example, different conventional .308 caliber rifles can have different magazines for the same caliber round.

In various embodiments, a modular bolt action rifle provides for the mounting of different caliber barrels by assembling the barrel assembly to the upper receiver into the barrel receiver extension, with a détente at the 12 o'clock position, and attaching a handguard or rail assembly to the barrel extension and the upper receiver with one or more shoulder screws which, when tightened, both compress the rail assembly to both the barrel receiver extension and secure the rail assembly to the barrel receiver extension, magazine well, and upper receiver assembly by engaging one or more channels in the barrel receiver extension.

In various embodiments, to keep the handguard from rotating off the barrel receiver extension upper receiver assembly during firing of the rifle, the handguard portion is attached to the barrel receiver extension with the détente at the 12 o'clock position and one or more shoulder screws that compress the open machined slot at the 6 o'clock position on the hand guard portion.

In various embodiments, one or more channels is machined in the outside diameter of the barrel receiver extension through which a corresponding number of shoulder screws is inserted, further keeping the hand guard portion from traveling forward along the barrel toward the muzzle during firing of the rifle. In this manner, the barrel assembly remains properly and securely attached to the upper receiver assembly of the rifle system.

In various embodiments, the changing of bolt calibers, changing of magazines, and securing of the barrel assembly for the corresponding caliber to the upper receiver assembly can be accomplished in the field without any additional specialized tools, providing a distinct advantage to military and law enforcement personnel in combat conditions or conflict situations and to other users needing the ability to quickly assemble, change the caliber, disassemble, or store the rifle system in a compact fashion.

Figure 2:
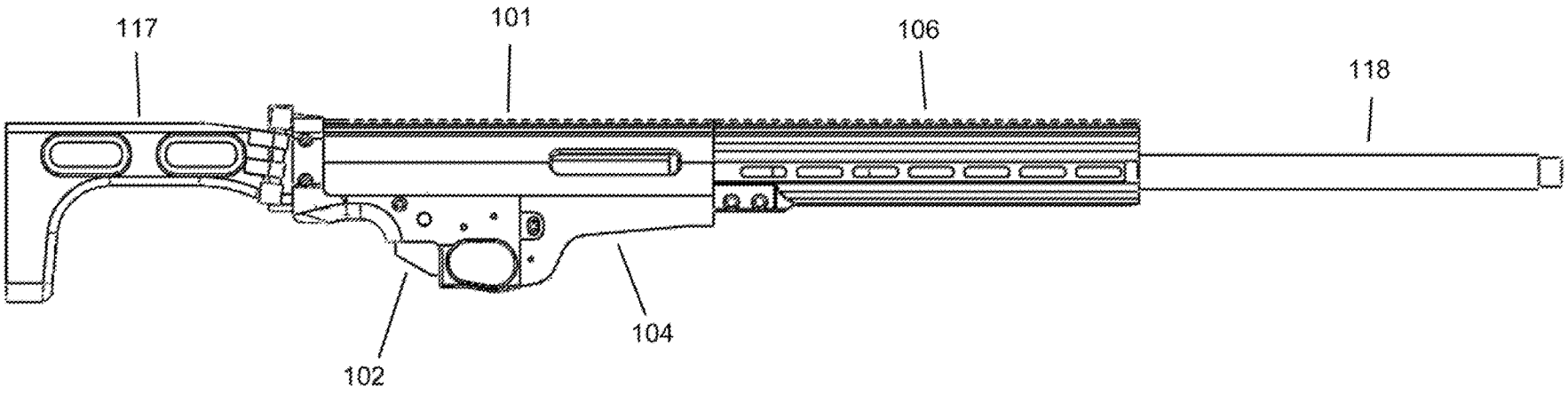
FIG. 2 is a perspective view of the assembled modular bolt action rifle system, showing the upper receiver, fire control, magazine well, stock, barrel, and handguard assembled in accordance with one exemplary embodiment of the present disclosure.
Figure 3:
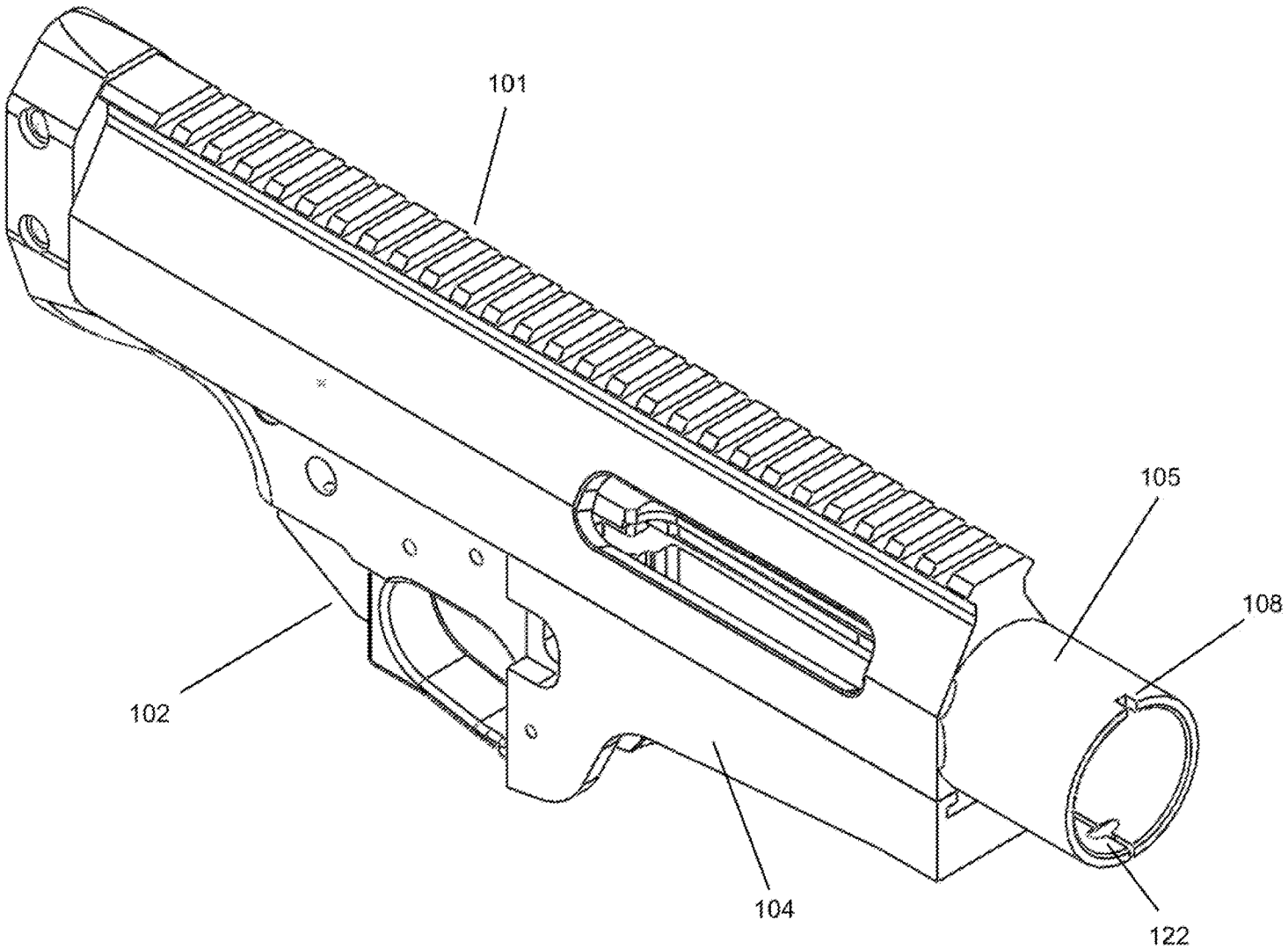
FIG. 3 is a perspective view of the assembled modular bolt action rifle system, without a stock, barrel or handguard attached for demonstrative purposes, showing the upper receiver, fire control, magazine well, and bolt carrier group assembled in accordance with one exemplary embodiment of the present disclosure.
Figure 4:
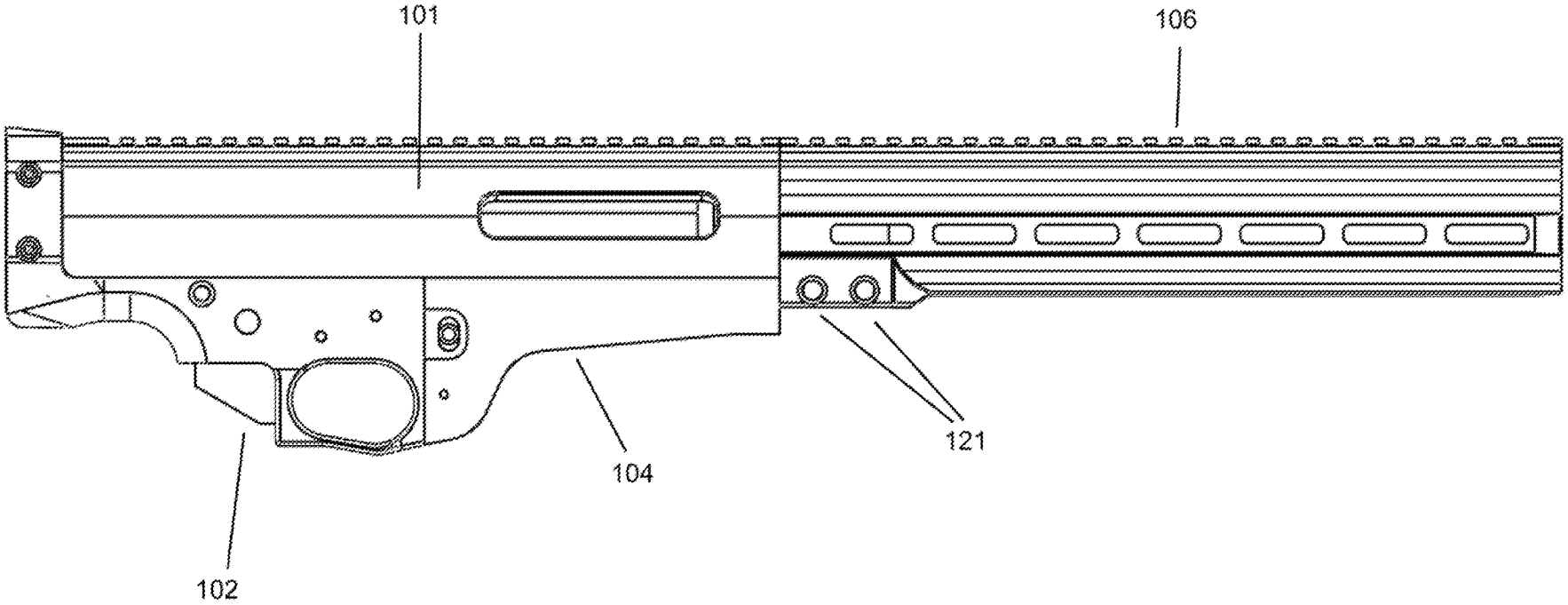
FIG. 4 is a perspective view of the assembled modular bolt action rifle system, shown without a stock or barrel for demonstrative purposes, showing the upper receiver, fire control, magazine well, handguard, and bolt carrier group assembled in accordance with one exemplary embodiment of the present disclosure.
Figure 5:
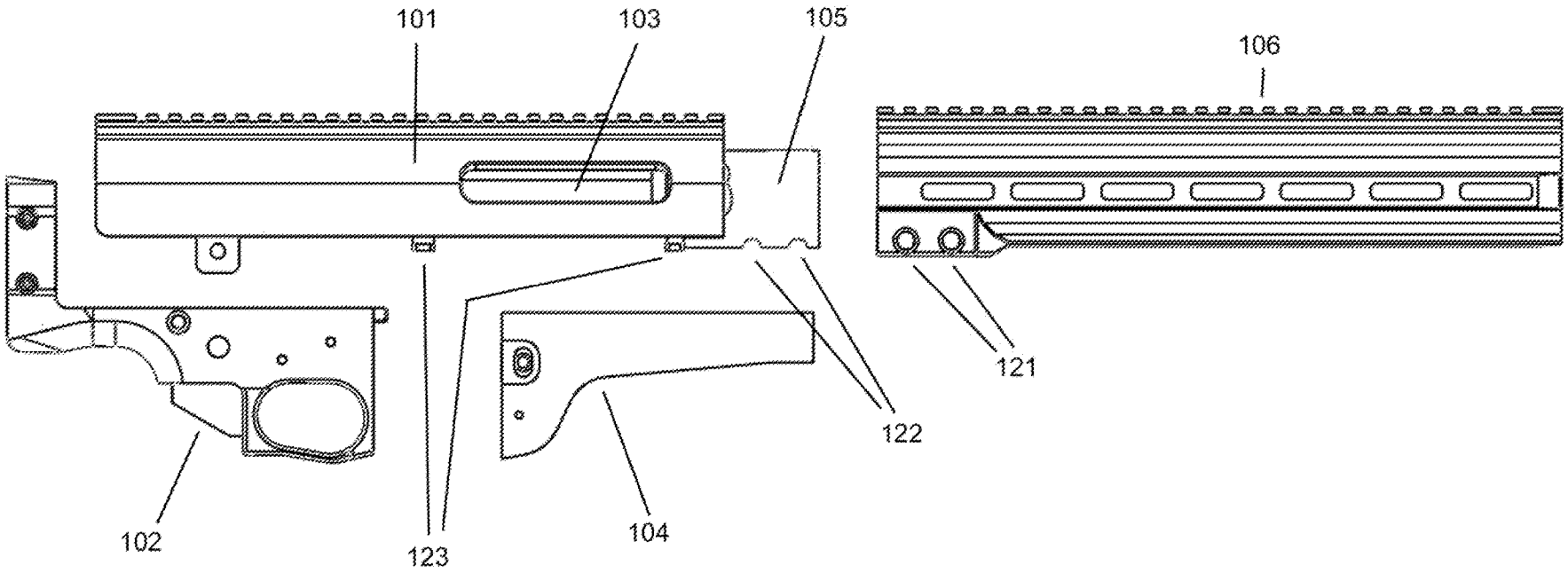
FIG. 5 is an exploded perspective of the modular bolt action rifle system, without a barrel for demonstrative purposes, showing the upper receiver, fire control, magazine well, handguard, and bolt carrier group disassembled in accordance with one exemplary embodiment of the present disclosure.
Figure 6:
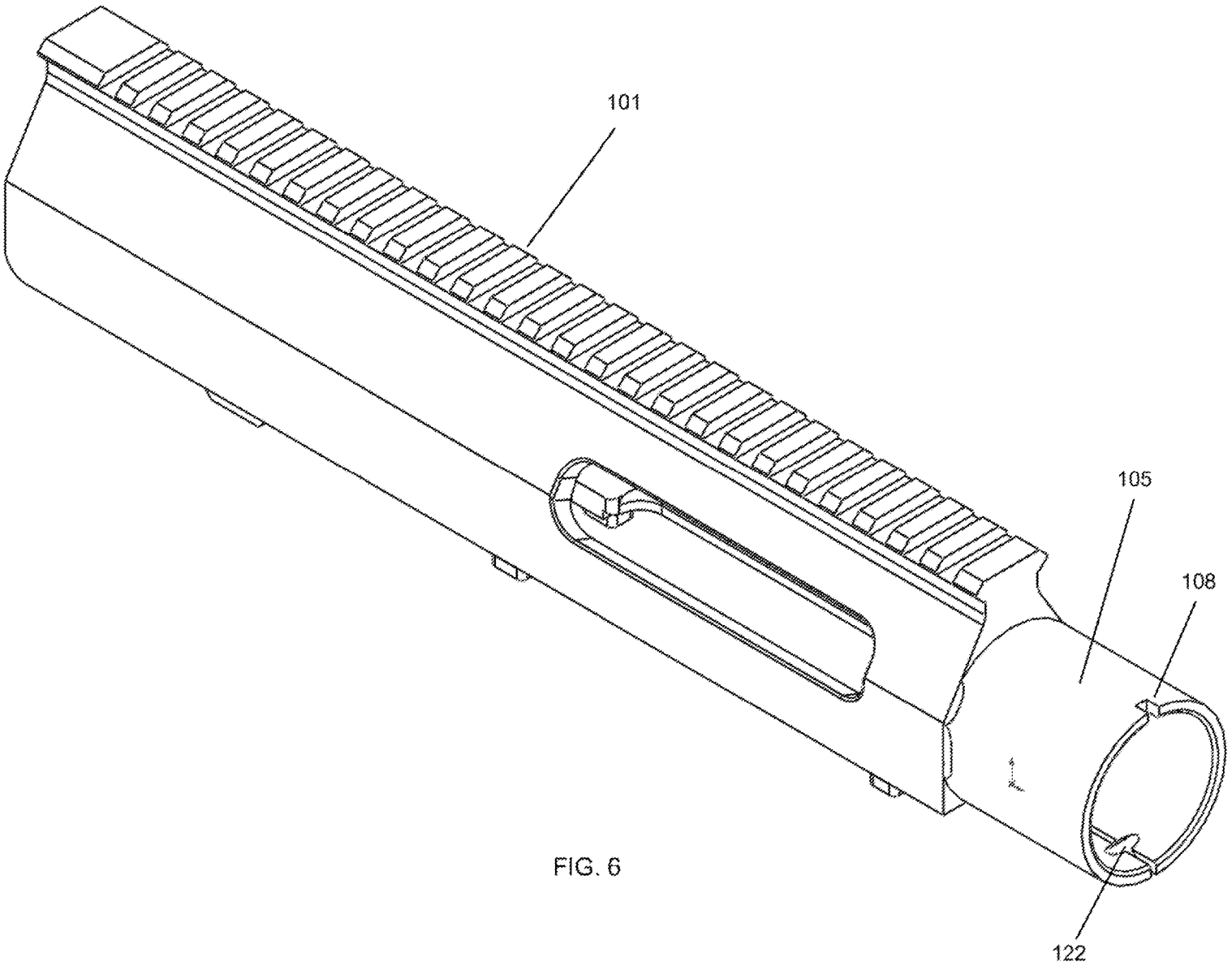
FIG. 6 is a perspective view of the upper receiver of the modular bolt action rifle, in accordance with one exemplary embodiment of the present disclosure.
Figure 7:
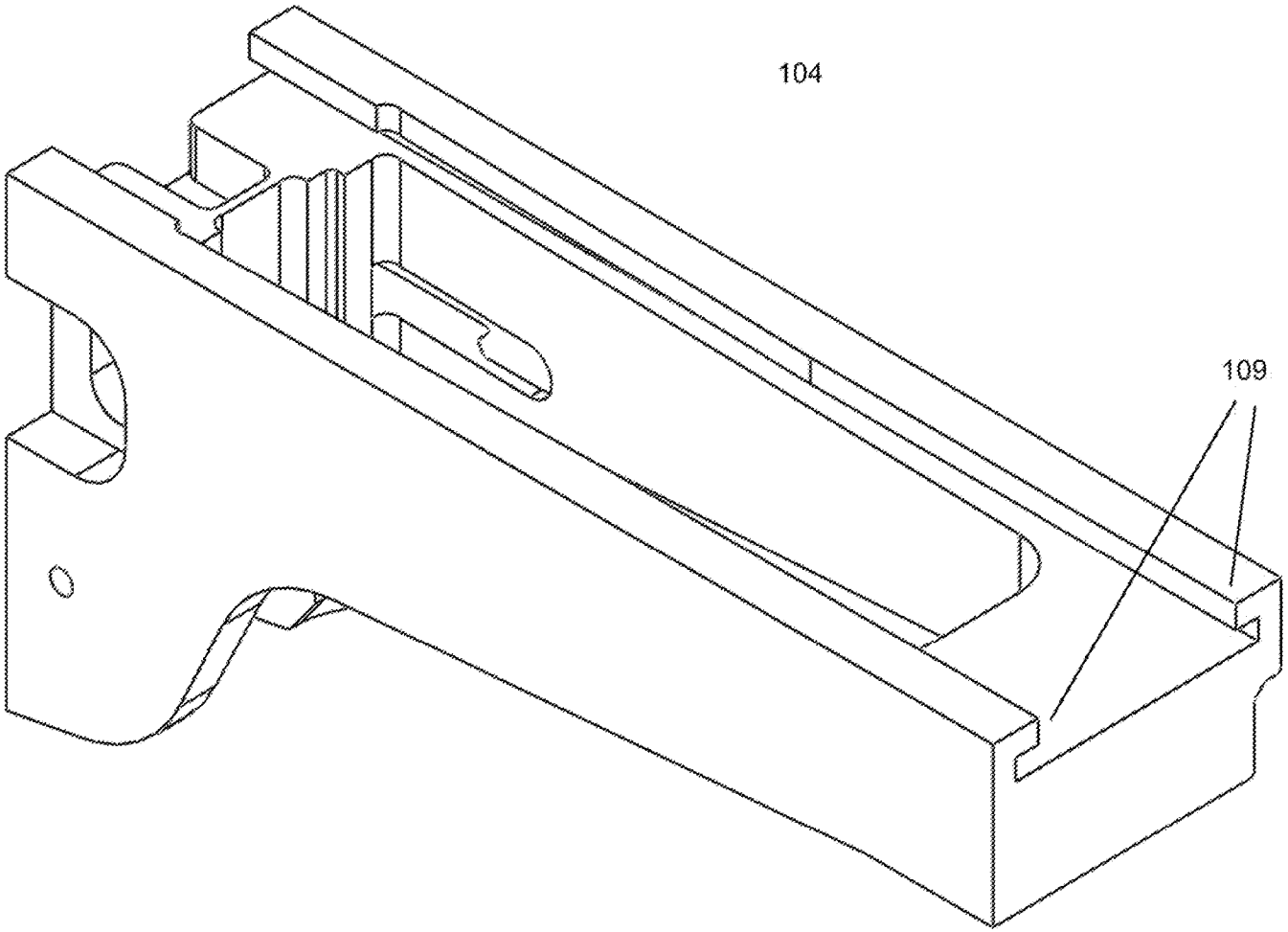
FIG. 7 is a perspective view of the floating magazine well of the modular bolt action rifle, in accordance with one exemplary embodiment of the present disclosure.
Figure 8:
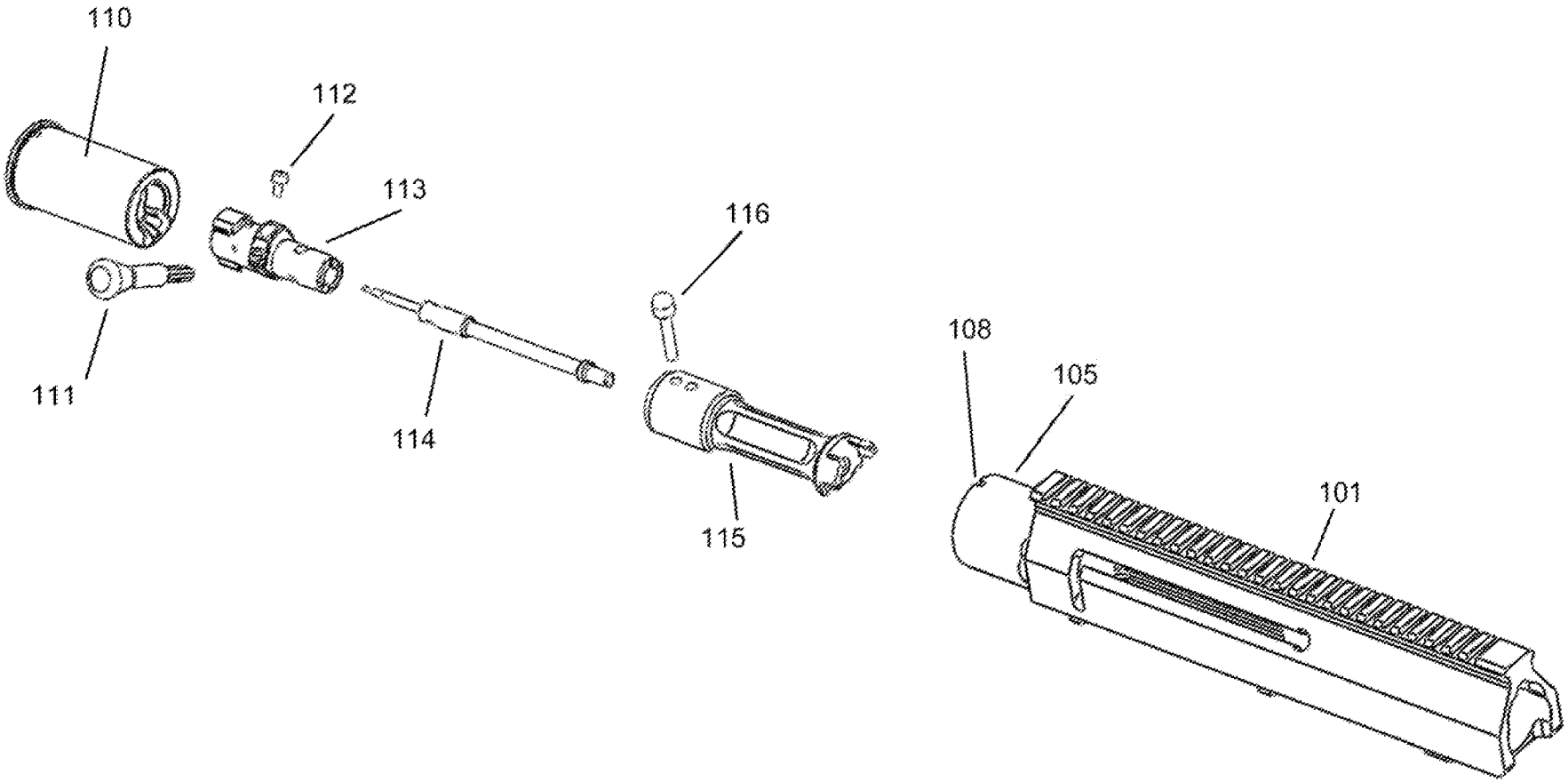
FIG. 8 is an exploded perspective of the bolt carrier group assembly of the modular bolt action rifle system, disassembled in accordance with one exemplary embodiment of the present disclosure. Included in the bolt carrier group assembly are a bolt, a bolt handle fastener, a charging handle, a firing pin, a bolt carrier, and a guide pin to attach the bolt carrier to the bolt.
Figure 9:
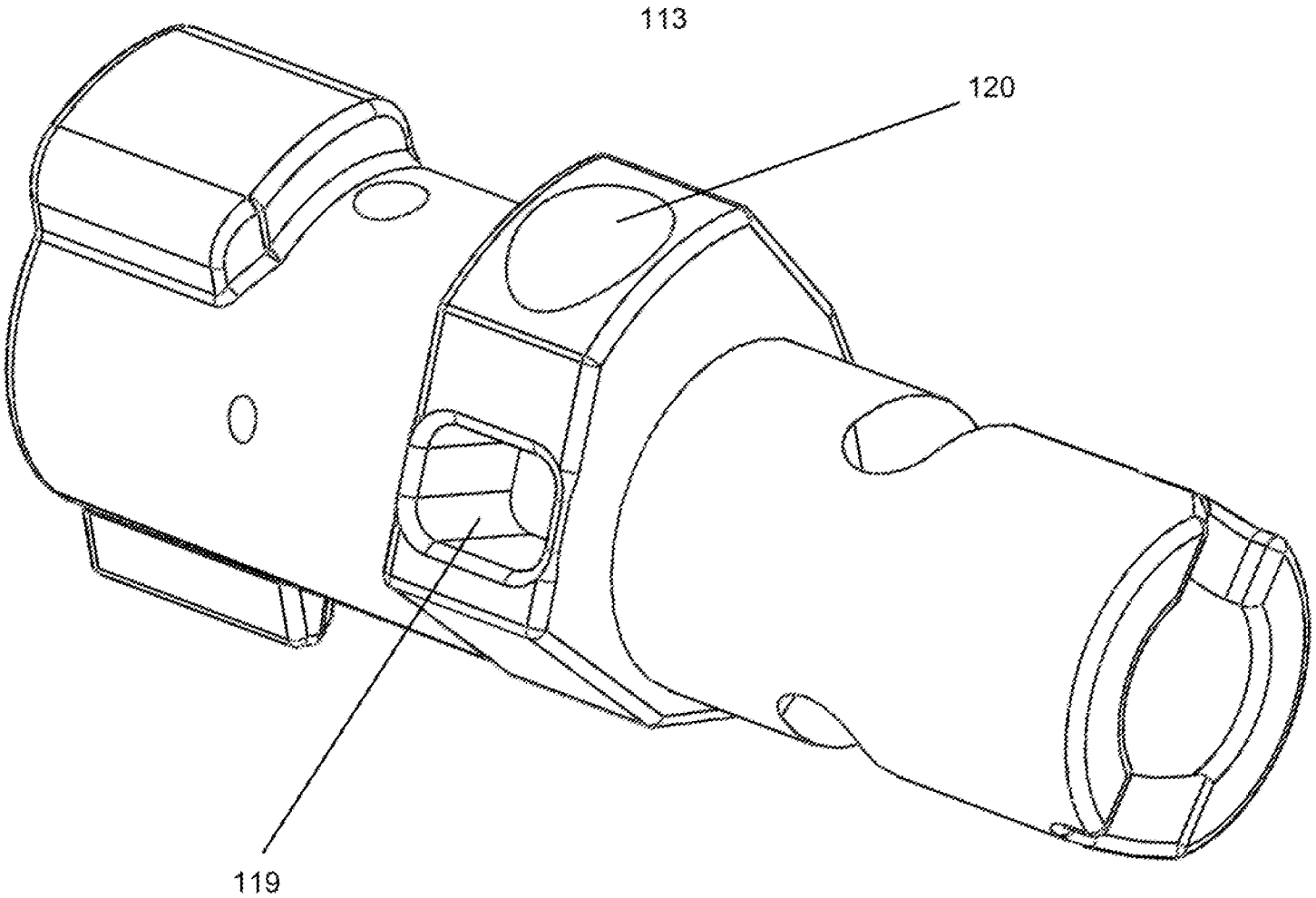
FIG. 9 is a perspective view of the bolt of the modular bolt action rifle, in accordance with one exemplary embodiment of the present disclosure. Included in the bolt are a charging handle receptacle and a bolt retaining pin receptable.
Figure 10:
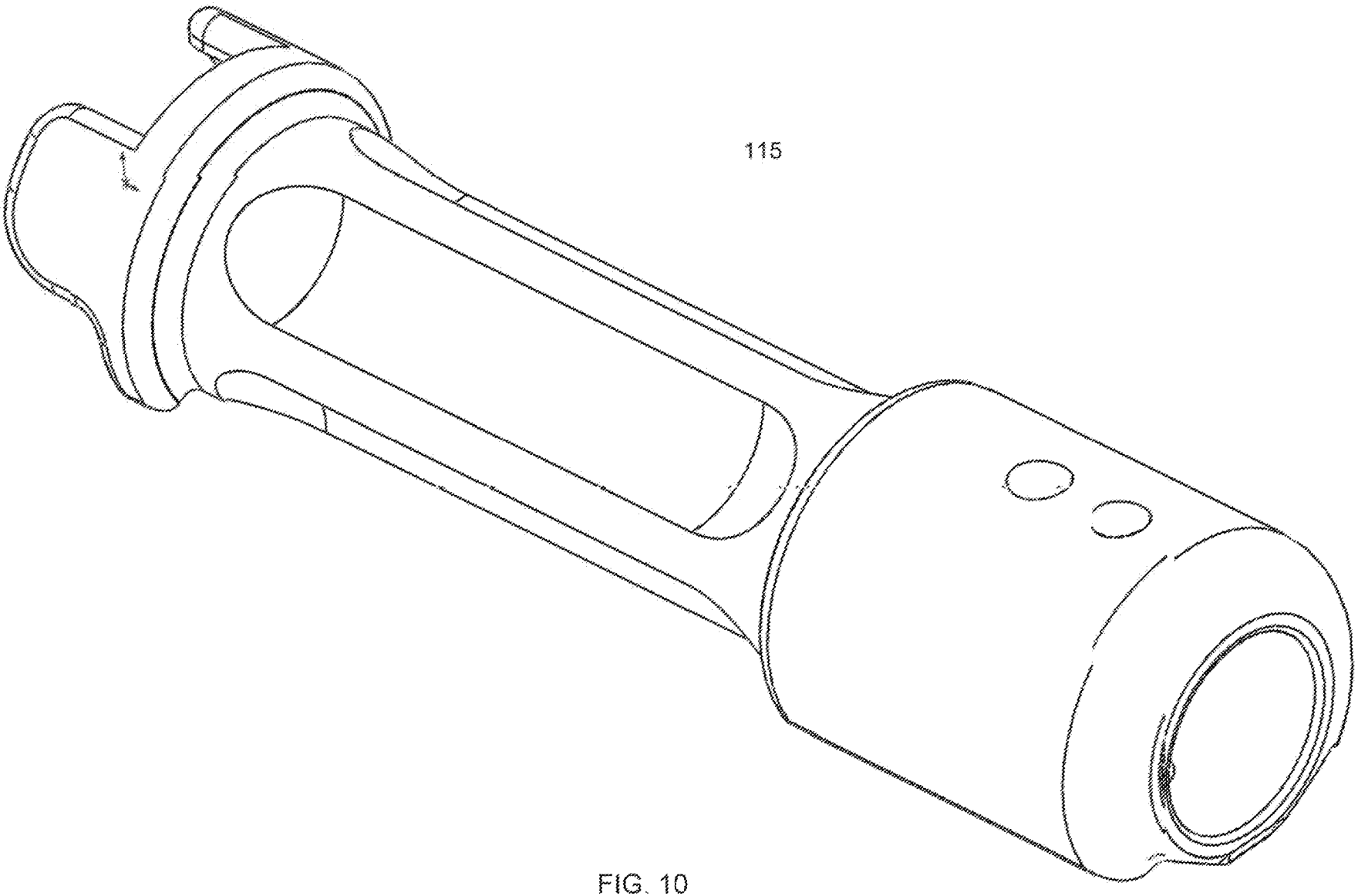
FIG. 10 is a perspective view of the bolt carrier of the modular bolt action rifle, in accordance with one exemplary embodiment of the present disclosure.
Figure 11:
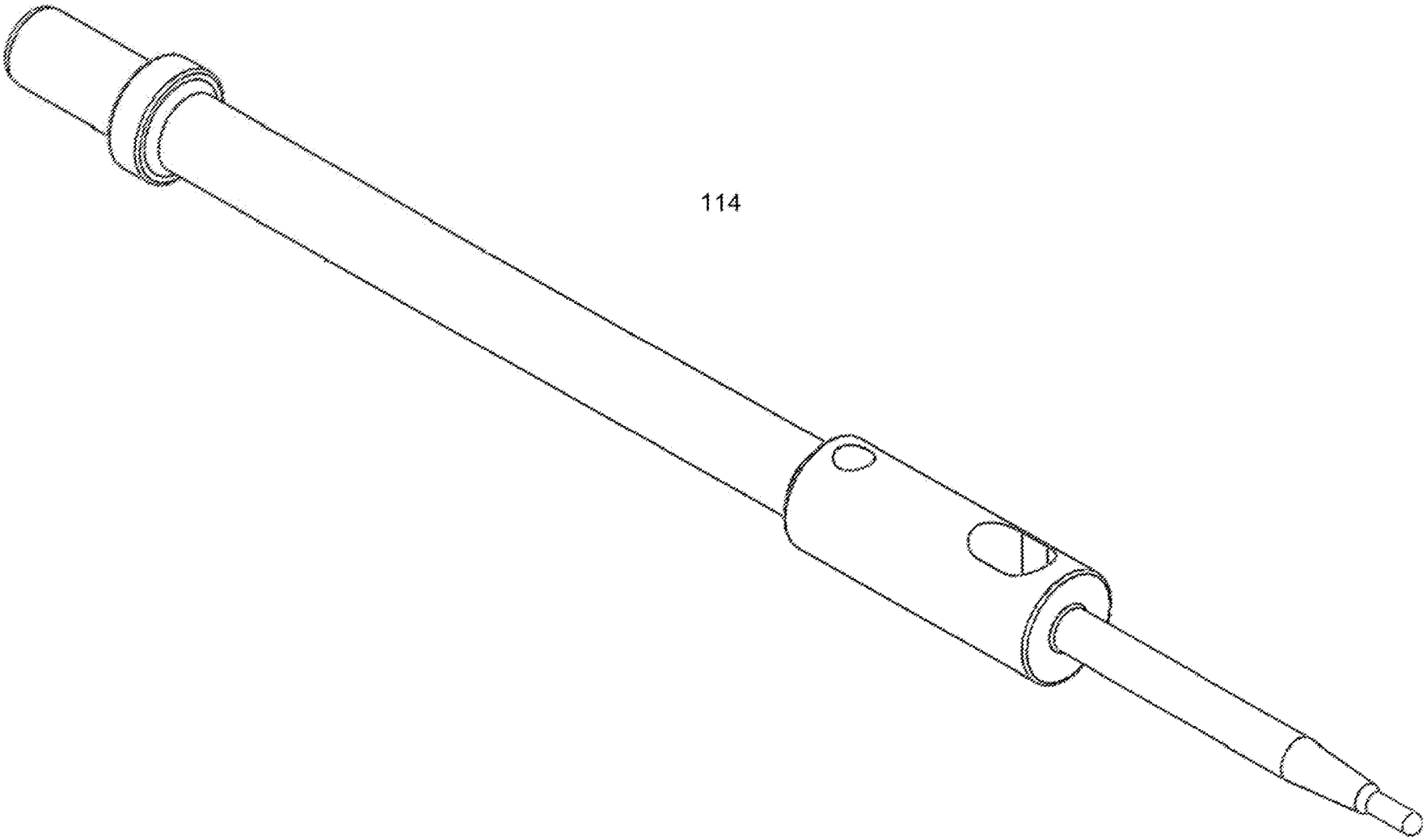
FIG. 11 is a perspective view of the firing pin of the modular bolt action rifle, in accordance with one exemplary embodiment of the present disclosure.
Figure 12:
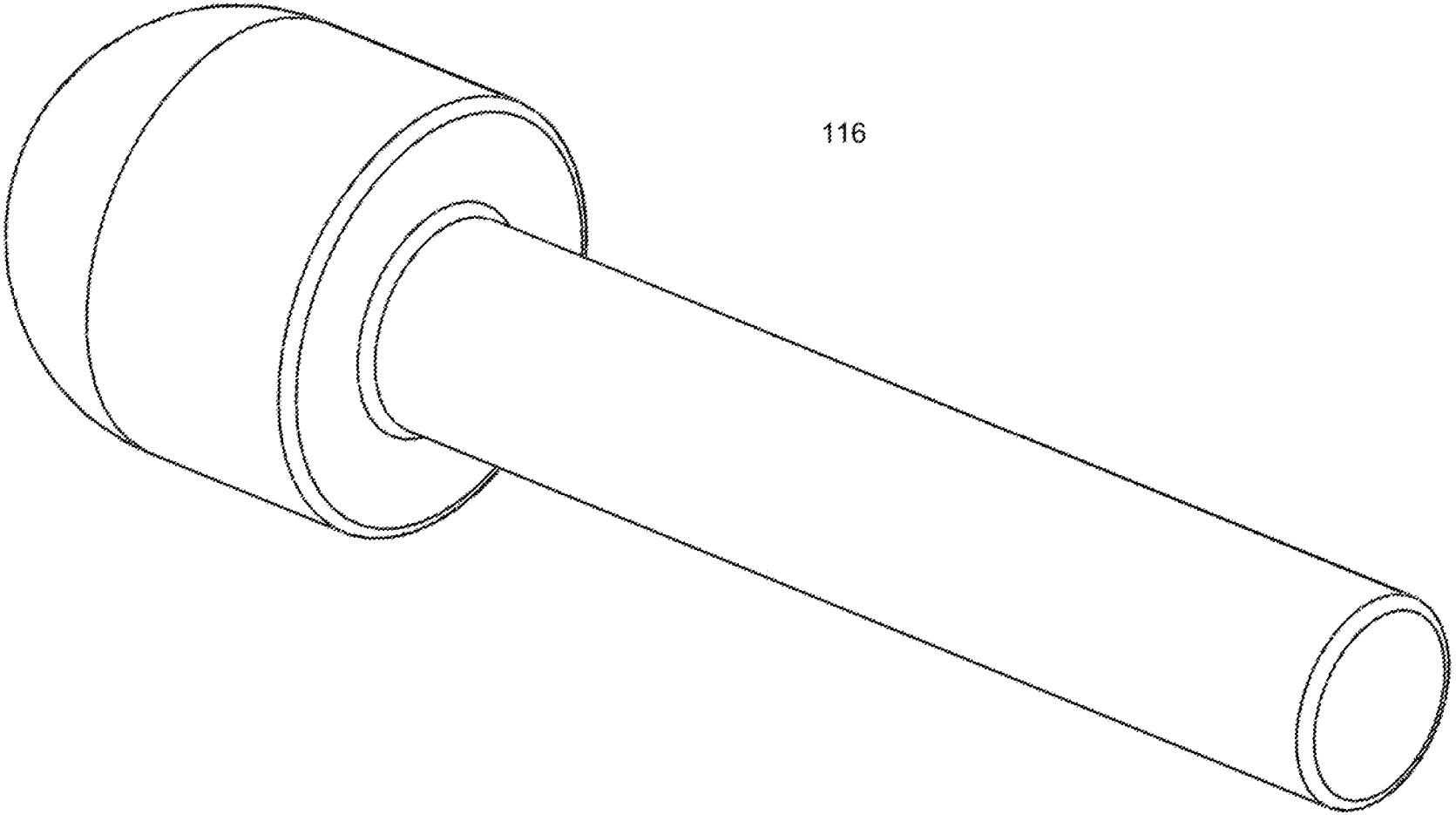
FIG. 12 is a perspective view of the bolt guide pin of the modular bolt action rifle, in accordance with one exemplary embodiment of the present disclosure.
Figure 13:
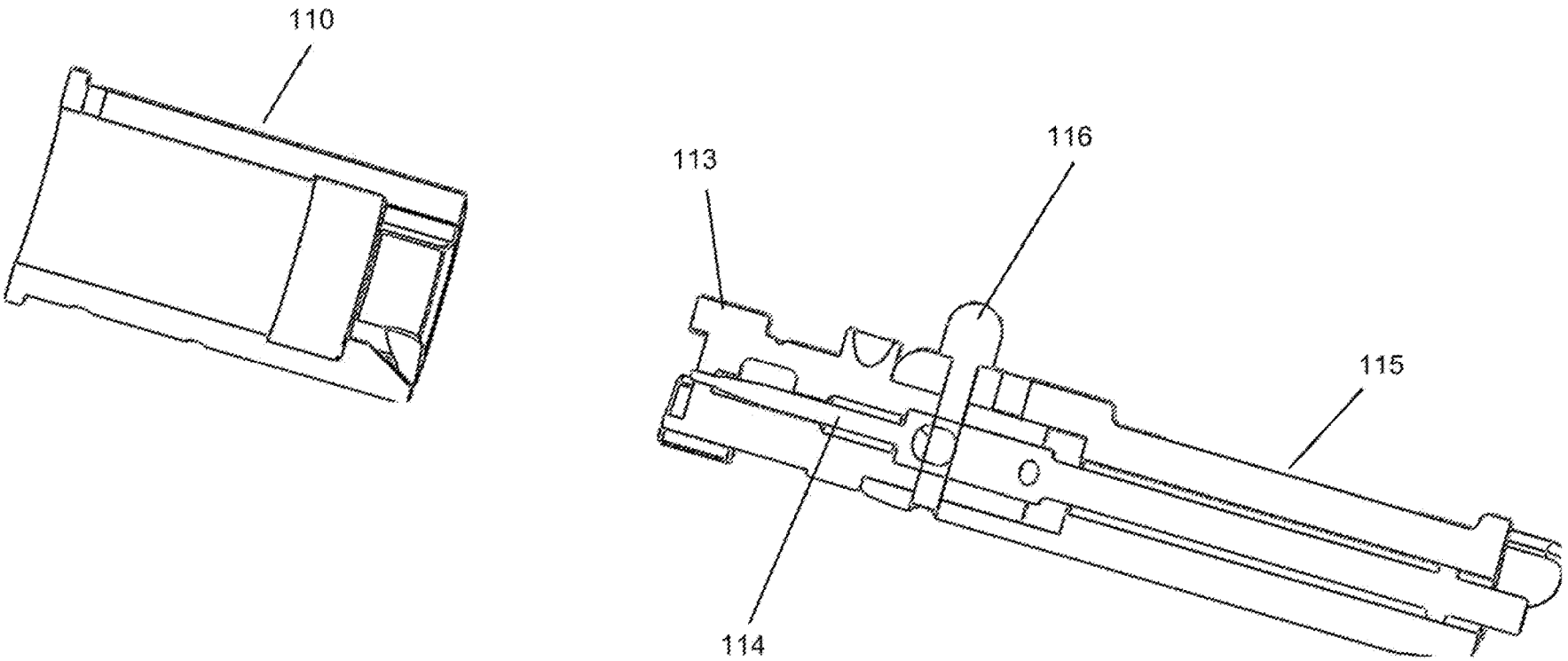
FIG. 13 is a section view of the assembled bolt carrier group assembly, showing the bolt, bolt carrier, firing pin, and guide pin assembled in accordance with one exemplary embodiment of the present disclosure.
Figure 14:
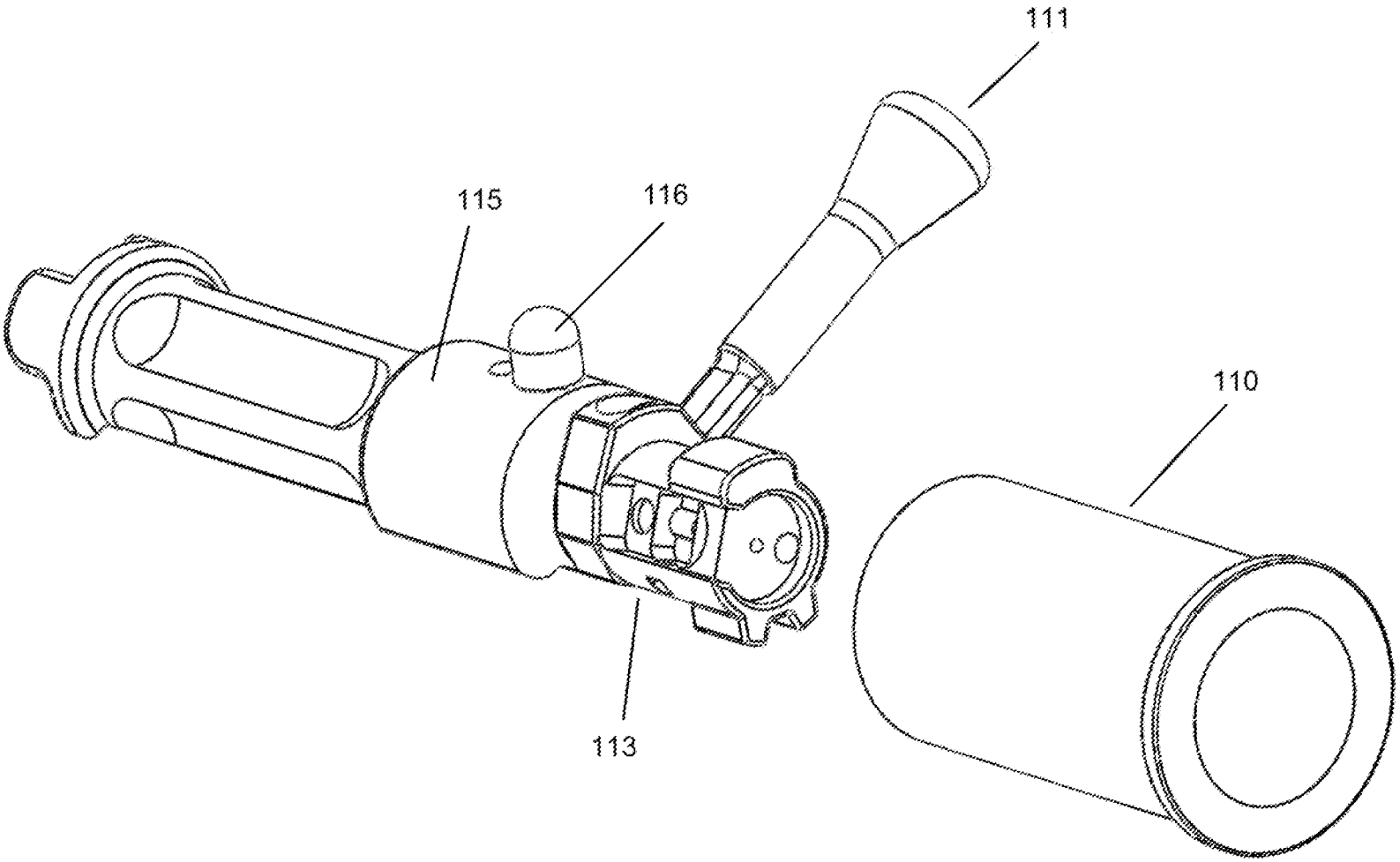
FIG. 14 is a perspective view of the assembled bolt carrier group assembly, showing the bolt, bolt carrier, and guide pin (without the firing pin for demonstrative purposes) assembled in accordance with one exemplary embodiment of the present disclosure.
Figure 15:
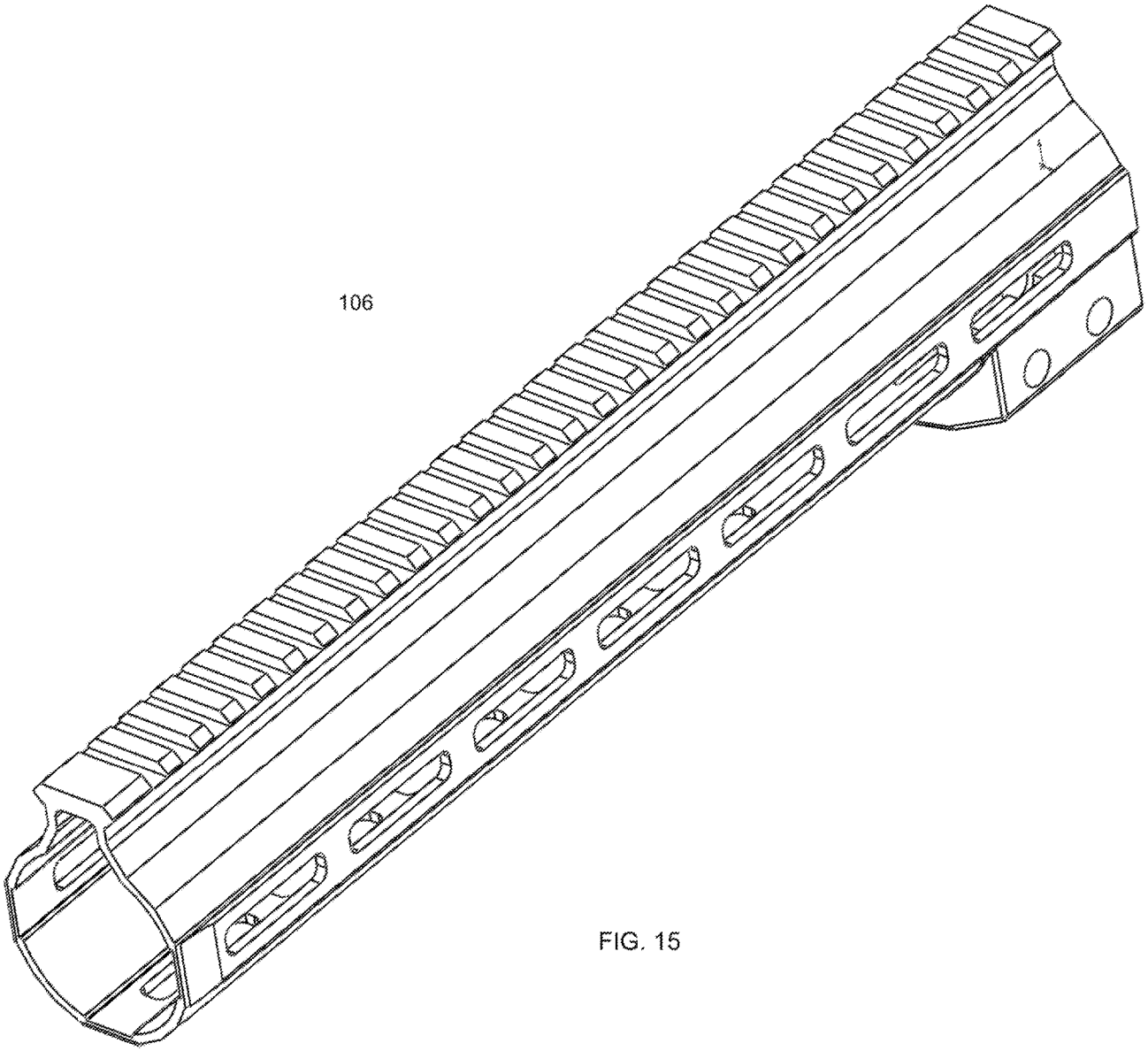
FIG. 15 is a perspective view of the handguard (with rail) assembly of the modular bolt action rifle, in accordance with one exemplary embodiment of the present disclosure.
Figure 16:
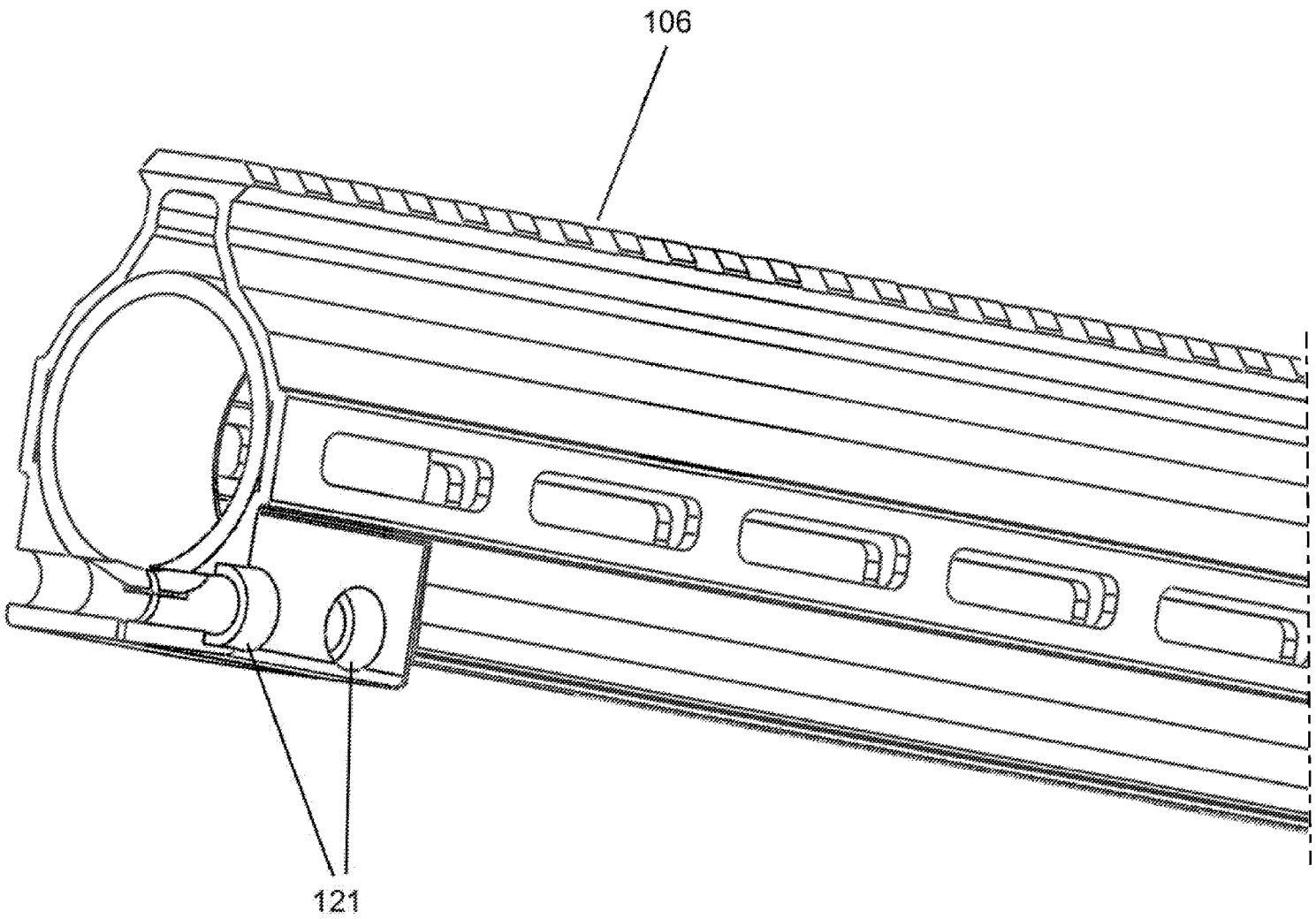
FIG. 16 is a sectioned perspective view of the clamping section of the handguard (with rail) assembly of the modular bolt action rifle (without shoulder screws for demonstrative purposes), in accordance with one exemplary embodiment of the present disclosure.

One exemplary embodiment of the modular bolt action rifle system is illustrated in FIGS. 1-16, where FIG. 1 is a perspective view of the assembled modular bolt action rifle system, showing the upper receiver, fire control, magazine well, stock, barrel, and handguard assembled in accordance with one exemplary embodiment of the present disclosure; FIG. 2 is a perspective view of the assembled modular bolt action rifle system, showing the upper receiver, fire control, magazine well, stock, barrel, and handguard assembled in accordance with one exemplary embodiment of the present disclosure; FIG. 3 is a perspective view of the assembled modular bolt action rifle system, without a stock, barrel or handguard attached for demonstrative purposes, showing the upper receiver, fire control, magazine well, and bolt carrier group assembled in accordance with one exemplary embodiment of the present disclosure; FIG. 4 is a perspective view of the assembled modular bolt action rifle system, shown without a stock or barrel for demonstrative purposes, showing the upper receiver, fire control, magazine well, handguard, and bolt carrier group assembled in accordance with one exemplary embodiment of the present disclosure; FIG. 5 is an exploded perspective of the modular bolt action rifle system, without a barrel for demonstrative purposes, showing the upper receiver, fire control, magazine well, handguard, and bolt carrier group disassembled in accordance with one exemplary embodiment of the present disclosure; FIG. 6 is a perspective view of the upper receiver of the modular bolt action rifle, in accordance with one exemplary embodiment of the present disclosure; FIG. 7 is a perspective view of the floating magazine well of the modular bolt action rifle, in accordance with one exemplary embodiment of the present disclosure; FIG. 8 is an exploded perspective of the bolt carrier group assembly of the modular bolt action rifle system, disassembled in accordance with one exemplary embodiment of the present disclosure. Included in the bolt carrier group assembly are a bolt, a bolt handle fastener, a charging handle, a firing pin, a bolt carrier, and a bolt carrier guide pin to attach the bolt carrier to the bolt; FIG. 9 is a perspective view of the bolt of the modular bolt action rifle, in accordance with one exemplary embodiment of the present disclosure. Included in the bolt are a charging handle receptacle and a bolt retaining pin receptable; FIG. 10 is a perspective view of the bolt carrier of the modular bolt action rifle, in accordance with one exemplary embodiment of the present disclosure; FIG. 11 is a perspective view of the firing pin of the modular bolt action rifle, in accordance with one exemplary embodiment of the present disclosure; FIG. 12 is a perspective view of the bolt carrier guide pin of the modular bolt action rifle, in accordance with one exemplary embodiment of the present disclosure; FIG. 13 is a section view of the assembled bolt carrier group assembly, showing the bolt, bolt carrier, firing pin, and guide pin assembled in accordance with one exemplary embodiment of the present disclosure; FIG. 14 is a perspective view of the assembled bolt carrier group assembly, showing the bolt, bolt carrier, and guide pin (without the firing pin for demonstrative purposes) assembled in accordance with one exemplary embodiment of the present disclosure; FIG. 15 is a perspective view of the handguard (with rail) assembly of the modular bolt action rifle, in accordance with one exemplary embodiment of the present disclosure; and FIG. 16 is a sectioned perspective view of the clamping section of the handguard (with rail) assembly of the modular bolt action rifle (without shoulder screws for demonstrative purposes), in accordance with one exemplary embodiment of the present disclosure.

Here, the system includes an upper receiver assembly 101 housing a barrel, an AR-style fire control system 102, a bolt carrier group assembly 103 including bolt 113, bolt carrier 115, and firing pin 114, a floating magazine well 104, and a handguard assembly 106. Optionally, the system may include a stock or grip. The AR-style fire control 102 is releasably attached to the upper receiver 101 using a conventional AR retaining pin. The magazine well 104 is releasably attached to the upper receiver assembly 101 by inserting the top channel 109 of the magazine well onto tabs 123 on the underside of the upper receiver 101. Prior to attachment of the barrel assembly, the bolt carrier assembly 103, consisting of a bolt 113, bolt handle fastener 112, charging handle 111, firing pin 114, bolt carrier guide pin 116, and bolt carrier 115, is inserted unto the upper receiver 101. The barrel extension 110 is releasably attached to the upper receiver 101 into a barrel extension receiver 105 with a détente 108 at the 12 o'clock position. The barrel assembly and magazine well 102 are releasably secured by releasable attachment of the handguard assembly 106 to the barrel extension receiver 105 of the upper receiver assembly 101 by insertion of one or more shoulder screws into shoulder screw receptacles 121 which, when the screw are tightened, both compress the handguard assembly 106 to the barrel extension receiver 105 and secure the handguard assembly 106 to the barrel extension receiver 105, magazine well 102, and upper receiver assembly 101 by engaging one or more channels 122 in the barrel extension receiver 105.

While particular embodiments of modular bolt action rifles and rifle systems have been disclosed in detail in the foregoing description and figures for purposes of example, those skilled in the art will understand that variations and modifications may be made without departing from the scope of the disclosure. All such variations and modifications are intended to be included within the scope of the present disclosure and protected by the following claims.

Therefore, having thus described the disclosure, at least the following is claimed:

1. A modular bolt-action rifle system, comprising:

an upper receiver assembly comprising a bolt carrier group assembly;

a fire control system;

a magazine well;

a barrel assembly; and a handguard assembly;

wherein the upper receiver assembly is releasably attached to the fire control system, the magazine well is releasably attached to the upper receiver assembly by inserting the magazine well into a channel on an underside of the upper receiver assembly, and the barrel assembly is releasably attached to the upper receiver assembly into a barrel receiver extension with a detente at a 12 o'clock position; and wherein the barrel assembly and magazine well are releasably secured by releasable attachment of the handguard assembly to the barrel receiver extension of the upper receiver assembly by insertion of one or more shoulder screws.

2. The modular bolt-action rifle system of claim 1, wherein the fire control system is an AR-style fire control system.

3. The modular bolt-action rifle system of claim 2, wherein the AR-style fire control is releasably attached to the upper receiver assembly using a retaining pin.

4. The modular bolt-action rifle system of claim 1, wherein the magazine well is a floating magazine well.

5. The modular bolt-action rifle system of claim 1, wherein the one or more shoulder screws compress a handguard assembly to both the barrel receiver extension and secure the handguard assembly to the barrel receiver extension, magazine well, and upper receiver assembly by engaging one or more channels in the barrel receiver extension.

6. The modular bolt-action rifle system of claim 1, wherein the fire control is an AR-style fire control and is releasably attached to the upper receiver assembly using a retaining pin, and wherein the bolt carrier group assembly comprises a bolt, a charging handle fastener, a charging handle, a firing pin, a bolt carrier guide pin, and a bolt carrier.

7. The modular bolt action rifle system of claim 6, wherein the firing pin comprises a machined slot to receive the bolt carrier guide pin and the guide pin inserts into a slot in the bolt carrier.

8. The modular bolt action rifle system of claim 7, wherein a caliber of the rifle is interchangeable with another caliber by:

removing the bolt carrier guide pin, allowing for disassembly of the bolt carrier group assembly, and interchanging a different caliber bolt and barrel assembly.

9. The modular bolt action rifle system of claim 8, wherein the caliber of the rifle is interchangeable among .338 Lapua, .338 Norma, .300 Norma, .416 Rigby, and .308 calibers by:

removing the bolt carrier guide pin, allowing for disassembly of the bolt carrier group assembly, and interchanging a .338 Lapua, .338 Norma, .300 Norma, .416 Rigby, or .308 caliber bolt and barrel assembly.

10. A modular bolt-action rifle system, comprising:

an upper receiver assembly comprising a bolt carrier group assembly comprising a bolt, a charging handle fastener, a charging handle, a firing pin, a bolt carrier guide pin, and a bolt carrier;

a fire control system, wherein the fire control system is an AR-style fire control system and is releasably attached to the upper receiver assembly using an AR-style retaining pin;

a floating magazine well;

a barrel assembly, wherein the barrel assembly is releasably attached to the upper receiver assembly into a barrel receiver extension with a détente at a 12 o'clock position; and a handguard assembly;

wherein the upper receiver assembly is releasably attached to the fire control system, the magazine well is releasably attached to the upper receiver assembly by inserting the magazine well into a channel on an underside of the upper receiver assembly, and the barrel assembly is releasably attached to the upper receiver assembly;

wherein the barrel assembly and magazine well are releasably secured by releasable attachment of the handguard assembly to the barrel receiver extension of the upper receiver assembly by insertion of one or more shoulder screws;

wherein the one or more shoulder screws compress a handguard assembly to both the barrel receiver extension and secure the handguard assembly to the barrel receiver extension, magazine well, and upper receiver assembly by engaging one or more channels in the barrel receiver extension;

wherein the firing pin comprises a machined slot to receive the bolt carrier guide pin and the bolt carrier guide pin inserts into a slot in the bolt carrier; and wherein a caliber of the rifle is interchangeable with another caliber by removing the bolt carrier guide pin, allowing for disassembly of the bolt carrier group assembly, and interchanging a different caliber bolt and barrel assembly.

11. The modular bolt action rifle system of claim 10, wherein the caliber of the rifle is interchangeable among .338 Lapua, .338 Norma, .300 Norma, .416 Rigby, and .308 calibers by removing the bolt carrier guide pin, allowing for disassembly of the bolt carrier group assembly, and interchanging a .338 Lapua, .338 Norma, .300 Norma, .416 Rigby, or .308 caliber bolt and barrel assembly.

12. A modular bolt-action rifle system, comprising:

an upper receiver assembly comprising a bolt carrier group assembly;

a fire control system;

a magazine well;

a barrel assembly; and a handguard assembly;

wherein the upper receiver assembly is releasably attached to the fire control system, the magazine well is releasably attached to the upper receiver assembly, and the barrel assembly is releasably attached to the upper receiver assembly;

wherein the fire control is an AR-style fire control and is releasably attached to the upper receiver assembly using a retaining pin, and wherein the bolt carrier group assembly comprises a bolt, a charging handle fastener, a charging handle, a firing pin, a bolt carrier guide pin, and a bolt carrier;

wherein the firing pin comprises a machined slot to receive the bolt carrier guide pin and the guide pin inserts into a slot in the bolt carrier; and wherein a caliber of the rifle is interchangeable with another caliber by:

removing the bolt carrier guide pin, allowing for disassembly of the bolt carrier group assembly, and interchanging a different caliber bolt and barrel assembly.

* * * * *